United States Patent [19]

Abdrabbo

[11] Patent Number: 4,920,584

[45] Date of Patent: May 1, 1990

[54] DISPOSABLE TOILET SEAT COVER AND METHOD OF MANUFACTURE

[76] Inventor: Ahmed H. Abdrabbo, 4 E. Garden Dr., Roselle, N.J. 07203

[21] Appl. No.: 169,162

[22] Filed: Mar. 8, 1988

Related U.S. Application Data

[63] Continuation-in-part of Ser. No. 40,066, Apr. 20, 1987, abandoned.

[51] Int. Cl.[5] ..... A47K 13/14

[52] U.S. Cl. ..... 4/242; 4/247

[58] Field of Search ..... 4/242–247; 493/960, 356, 362, 363, 361, 198, 288; 428/43; 83/660; 156/271

[56] References Cited

U.S. PATENT DOCUMENTS

| | | | |
|---|---|---|---|
| 1,125,847 | 1/1915 | Humphrey | 4/247 |
| 1,268,024 | 5/1918 | Levin | 4/243 |
| 1,304,511 | 5/1919 | Quackenbush | 4/243 |
| 1,873,225 | 8/1932 | Simon | 4/243 |
| 1,912,363 | 6/1933 | De Waide | 244/55.5 |
| 2,225,288 | 12/1940 | Woehlert | 493/238 |
| 2,280,092 | 4/1942 | Kirch et al. | 493/960 X |
| 3,851,341 | 12/1974 | Aoyama | 4/243 |
| 4,352,214 | 10/1982 | Belz | 4/243 |
| 4,500,307 | 2/1985 | Bridgeman | 493/196 |
| 4,525,880 | 7/1985 | Bass | 4/243 |
| 4,766,617 | 8/1988 | Thygesen et al. | 4/243 |

FOREIGN PATENT DOCUMENTS

| | | | |
|---|---|---|---|
| 210513 | 3/1956 | Australia | 4/242 |
| 2023875 | 11/1971 | Fed. Rep. of Germany | 4/244 |

*Primary Examiner*—Henry J. Recla
*Assistant Examiner*—R. M. Fetsuga
*Attorney, Agent, or Firm*—Rohm & Monsanto

[57] ABSTRACT

A sanitary toilet seat cover is formed of a nonporous, nondisintegratable material, such as plastic sheet material, for protecting a user from disease-causing microorganisms. The toilet seat cover of the present invention has integrally formed therewith a protective flap portion which ensures against contact by any part of the anatomy of the user with the inside of the front of either the commode or the toilet seat itself. In accordance with a manufacturing method aspect of the invention, a plurality of toilet seat covers are produced from a continuous sleeve of the nonporous material. After perforation lines are made in the sleeve to facilitate separation of the individual toilet seat covers, as well as removing a blank central portion and producing the protective flap, the continuous sleeve may be folded so that, after rolling, it can be accommodated on the axle of a dispenser having the dimensions of conventional bathroom tissue.

2 Claims, 3 Drawing Sheets

DISPOSABLE TOILET SEAT COVER AND METHOD OF MANUFACTURE

RELATIONSHIP TO OTHER PATENT APPLICATION

This application is a continuation-in-part of co-pending U.S. Application Ser. No. 040,066, filed on Apr. 20, 1987, now abandoned.

BACKGROUND OF THE INVENTION

This invention relates generally to disposable toilet seat covers, and, more particularly, to a toilet seat cover constructed of a non-porous plastic material, and methods of making and using same.

Every toilet seat is usually used by more than one person and in many places, particularly in hospitals, schools, theatres, restaurants and sports complexes, the same toilet seat is used by many people. Some of these people may have health problems, and some diseases can be transferred to other people by using the same toilet.

There are a number of sanitary toilet seat covers available commercially, but all suffer from one or more serious drawbacks. For example, one well-known toilet seat cover which is described in U.S. Pat. No. 1,873,225 is formed of a tissue material which disintegrates in water. Clearly, although this achieves certain beneficial ends from the standpoint of convenience of disposability by simple flushing, the cover fails to provide the high level of protection from fluid-carried disease organisms, which is considered essential in view of present-day health concerns. Moreover, in situations of high moisture or humidity, particularly when the cover is used for an extended period of time, the known cover will adhere to the skin of the user, creating considerable inconvenience and discomfort, as well as possible skin irritation. The potential for irritation incident with the use of certain prior art toilet seat covers is increased by pleated structures, which additionally complicate the manufacturing process.

Commercially available sanitary toilet seat covers are costly to manufacture and difficult to make conveniently available for use in conventional rest room facilities. One approach to the manufacture of such covers is represented by U.S. Pat. No. 4,352,214 which describes a foil system wherein an adhesive surface on the foil is strengthened by having short individual fibers applied thereto. The toilet seat cover of that patent reference is manufactured in an endless chain having the full width of each cover. This relatively large width requires that the covers be individually folded and packaged, thereby requiring the use of bulky dispensers, which may include nonstandard wide rolls.

It is, therefore, an object of this invention to provide an improved disposable toilet seat cover which is inexpensive so as to be disposable after use and which is convenient to ship, store, dispense, and handle.

It is a further object of this invention to furnish a flexible toilet seat cover which is comfortable to use and additionally is provided with a smooth surface which does not irritate or adhere to the skin of the user.

It is an additional object of the invention to provide a disposable toilet seat cover which is large enough to prevent direct contact between the user and the toilet seat, as well as the interior rim of the commode.

It is also an object of the invention to provide a sanitary toilet seat cover which resists being torn by rough handling or during use, particularly when wet.

It is still another object of this invention to provide a sanitary toilet seat cover which protects male users from direct contact with the inside front surface of the toilet and the inside edge of the toilet seat.

It is yet a further object of the invention to prevent germs and other disease-causing organisms on the toilet seat, from reaching the body of the person using the toilet.

SUMMARY OF THE INVENTION

The foregoing and other objects are achieved by this invention which, in a first method aspect thereof, provides a method of making a sanitary toilet seat cover. In accordance with this aspect of the invention, a sleeve of flexible material is collapsed to form first and second layers having a predetermined width. The sleeve of flexible material is substantially continuous along a longitudinal direction. First and second two-layer perforation lines are arranged transverse to the longitudinal direction, these perforation lines being substantially straight throughout the predetermined width of the collapsed sleeve, and parallel to one another. Moreover, the two-layer perforation lines penetrate through both, the first and second layers, for facilitating detachment of the sanitary toilet seat cover from the sleeve of flexible material. A first single-layer perforation line is made in the first layer for permitting opening of the sleeve of flexible material. Additionally, a plurality of second single-layer perforation lines are arranged in the second layer for defining a blank central portion of the toilet seat cover and a protective front flap.

In a preferred embodiment of the invention, the sleeve of flexible material is formed of sheet plastic. This provides the desirable advantages of rendering the toilet seat cover to be waterproof, nonporous to prevent transference of disease-causing organisms, and highly resistant to disintegration in use, a feature which is particularly important for the front flap, which is highly likely to become wet in use.

In a highly advantageous embodiment of the invention, the sleeve of flexible material is folded longitudinally whereby the folded sleeve has an overall width which is smaller than the original width. In a specific illustrative embodiment of the invention, the toilet seat cover of the present invention may have overall deployed dimensions of approximately 17 inches long by 17 inches wide. Thus, the collapsed sleeve may have a width of approximately 8.5 inches. When folded once again, as described herein, the overall width is reduced to approximately 4.25 inches. The sleeve folded in this manner can be rolled so as to be accommodated on the axle of a conventional bathroom tissue dispenser. Of course, these dimensions are presented for purposes of enhancing the description of the invention, and persons skilled in the art can select dimensions which fulfill the objectives of the invention, while adapting the arrangement for conventional or custom dispensers.

In accordance with a further method aspect of the invention, two-layer perforation lines penetrate through both, the first and second layers, for facilitating detachment of the sanitary toilet seat cover from the sleeve of flexible material, as described hereinbefore. A first single-layer perforation line is made in the first layer in the vicinity of the first edge for permitting opening of the sleeve of flexible material. In this specific embodiment, a plurality of second double-layer perforation lines are arranged to define the blank central portion of the toilet seat cover and the protective front flap. The second double-layer perforation lines are arranged in the vicinity of the second edge of the continuous sleeve, and accordingly outline only one-half of the outline of the blank central portion. This has the advantage of facilitating removal of the blank central portion by simply pulling it off of the edge. Of course, in any embodiment of the invention, the blank central portion can be cut out entirely, and disposed of prior to packaging for consumer use.

In accordance with an apparatus aspect of the invention, a sanitary cover arrangement for a toilet seat, is formed from a sheet of nonporous material. The sheet has a waste portion in the form of a removable blank central, and a protective portion which is configured to overlie the toilet seat. The waste and protective portions are separated from one another by a perforation line, and the protective portion has incorporated therein a protective flap portion which is formed integrally therewith. The protective flap portion is defined in the protective portion at least partially by perforation lines, which are used to facilitate partial separation of the flap. This permits the flap to hang downward to protect the user from contacting the interior of the front of the toilet.

In a preferred embodiment, the sheet of nonporous material is one of a plurality of sheets of nonporous material obtained from a continuous web of nonporous material. In other words, each such sheet is but a section or portion of the continuous web, and is separable from sequentially prior and subsequent ones of other sheets of the continuous web via respective two-layer perforation lines.

As described hereinabove, the continuous web of nonporous material may be arranged, in certain embodiments, as a continuous sleeve of nonporous material. Preferable, the sleeve is collapsed to form first and second layers of nonporous material with first and second folds arranged longitudinally along the edges thereof. A perforation line extends longitudinally along the sleeve intermediate of the first and second folds to facilitate deployment of the toilet seat cover. Further perforation lines are used to outline the waste portion for facilitating separation thereof from the protective portion.

As indicated, the nonporous material may be a plastic sheet material, and may further be arranged as a sleeve. A practical toilet seat cover may be made using plastic having a thickness approximately between 0.7 mil and 1.3 mil, and preferably approximately 1 mil.

It is to be understood that, the disposable toilet seat cover can, in addition to the plastic sheet described hereinabove, be made of any other suitable, inexpensive, flexible, non-porous and nonabsorbent material, such as plastic film, plastic coated fabric, plastic coated paper, rubber or the like.

An important aspect of the present invention is to provide a toilet seat cover which is light in weight, resists tearing, and is readily disposable after use, so that the toilet seat cover can be folded, packaged in a small envelope which can readily be fit in a pocket, pocketbook or the like, and can be carried while travelling. Preferably, the packaging can be of a type which is conveniently opened.

BRIEF DESCRIPTION OF THE DRAWING

Comprehension of the invention is facilitated by reading the following detailed description in conjunction with the annexed drawing, in which.

DETAILED DESCRIPTION

Figure 1:
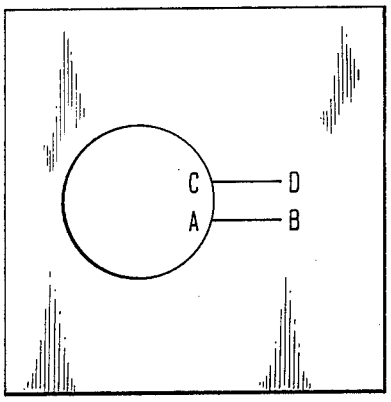
FIG. 1 is a plan view of one embodiment of a toilet seat cover produced in accordance with the present invention.

FIG. 1 is a plan view of one form of toilet seat cover embodying the present invention. In this embodiment the hole in the toilet seat cover is a circle and the portion which protects the user from the inside front surface of the toilet (not shown) is the area marked by letters A, B, C, D. on the drawings. In this embodiment, portion ABCD is partially separated at lines AB and CD.

Figure 2:
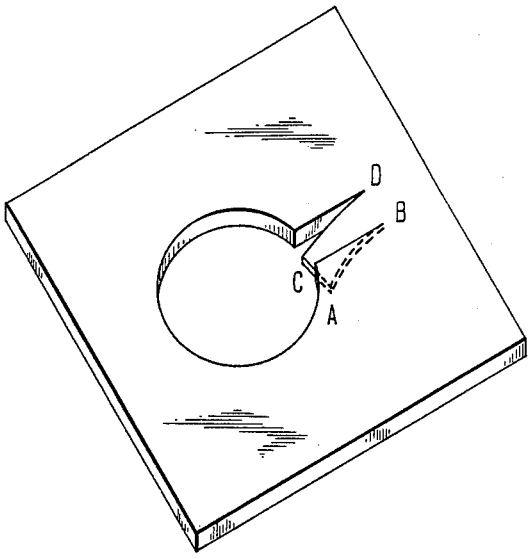
FIG. 2 is an isometric view of the embodiment of FIG. 1.

FIG. 2 is an isometric view of the toilet seat cover of FIG. 1 showing separation along the perforation lines AB and CD, to permit partial separation of portion ABCD from the remainder of the sanitary toilet seat cover, whereby it is permitted to fall downward into the toilet while in use.

Figure 3:
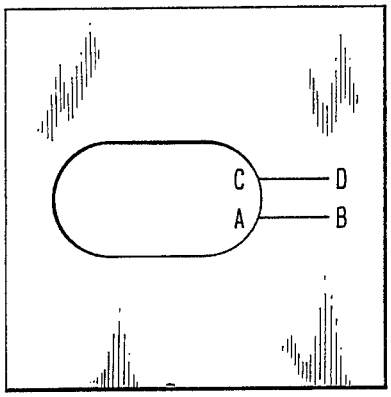
FIG. 3 is a plan view of another embodiment of a toilet seat cover produced in accordance with the present invention.

FIG. 3 is a plan view of another form of the toilet seat cover of the present invention. In this embodiment, the hole in the toilet seat cover has a rather oblong shape.

Figure 4:
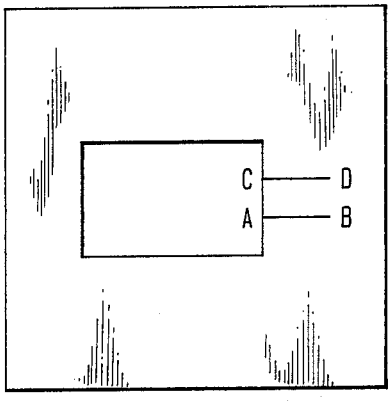
FIG. 4 is a plan view of still another embodiment of a toilet seat cover produced in accordance with the present invention.

FIG. 4 is a plan view of a still further embodiment of the sanitary toilet seat cover of the present invention. In this embodiment, the hole in the toilet seat cover is substantially rectangular.

Figure 5:
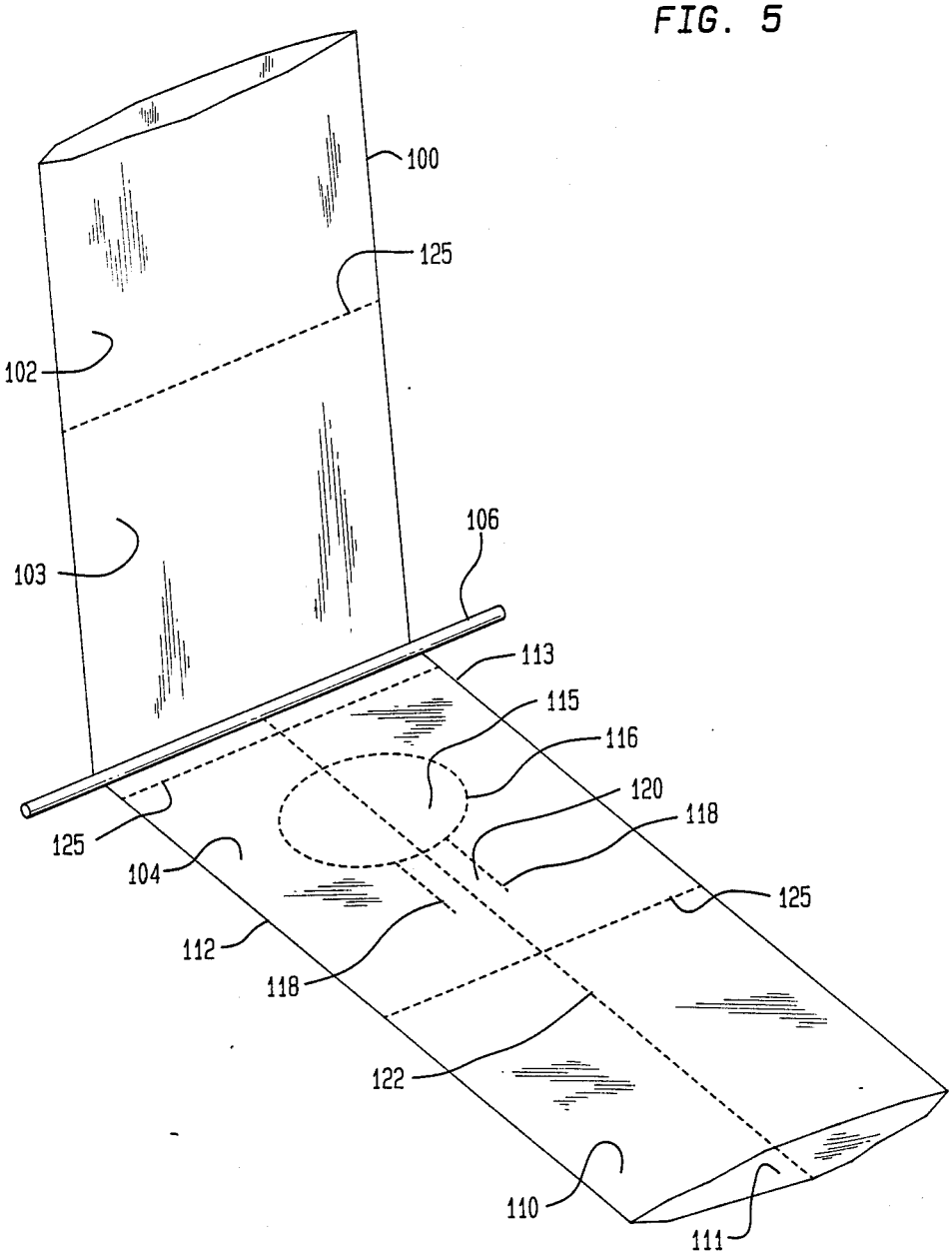
FIG. 5 is an isometric representation of a continuous web on which are formed, in accordance with the invention, a plurality of sanitary toilet seat covers.

FIG. 5 is an isometric representation of a continuous web 100 on which is shown to be formed, in accordance with the invention, a plurality of sanitary toilet seat covers 102, 103, and 104. Web 100 is continuous, and, in this embodiment, is a sleeve which, upon being flattened, or collapsed, by operation of a roller 106, produces two layers 110 and 111. Such flattening produces a fold edge 112 and a fold edge 113.

In this specific illustrative embodiment, a blank central portion 115 is outlined by a perforation line 116. Perforation line 116 is of a single-layer type, and does not cut into layer 111. Thus, the depth of penetration is limited to layer 110. In addition to the foregoing, a plurality of further perforation lines 118, which also are of the single-layer type, define a front protective flap portion 120. A longitudinal perforation line 122, which is shown in phantom representation in the figure, is produced as a single-layer type in layer 111.

As shown, toilet seat cover 104 is separable from continuous web 100 at separation lines 125. Separation lines 125 are double-layer perforation lines which penetrate layer 110 and layer 111. However, these perforation line do not cut continuous web 100 sufficiently to cause inadvertent separation of the toilet seat covers from one another.

Figure 6:
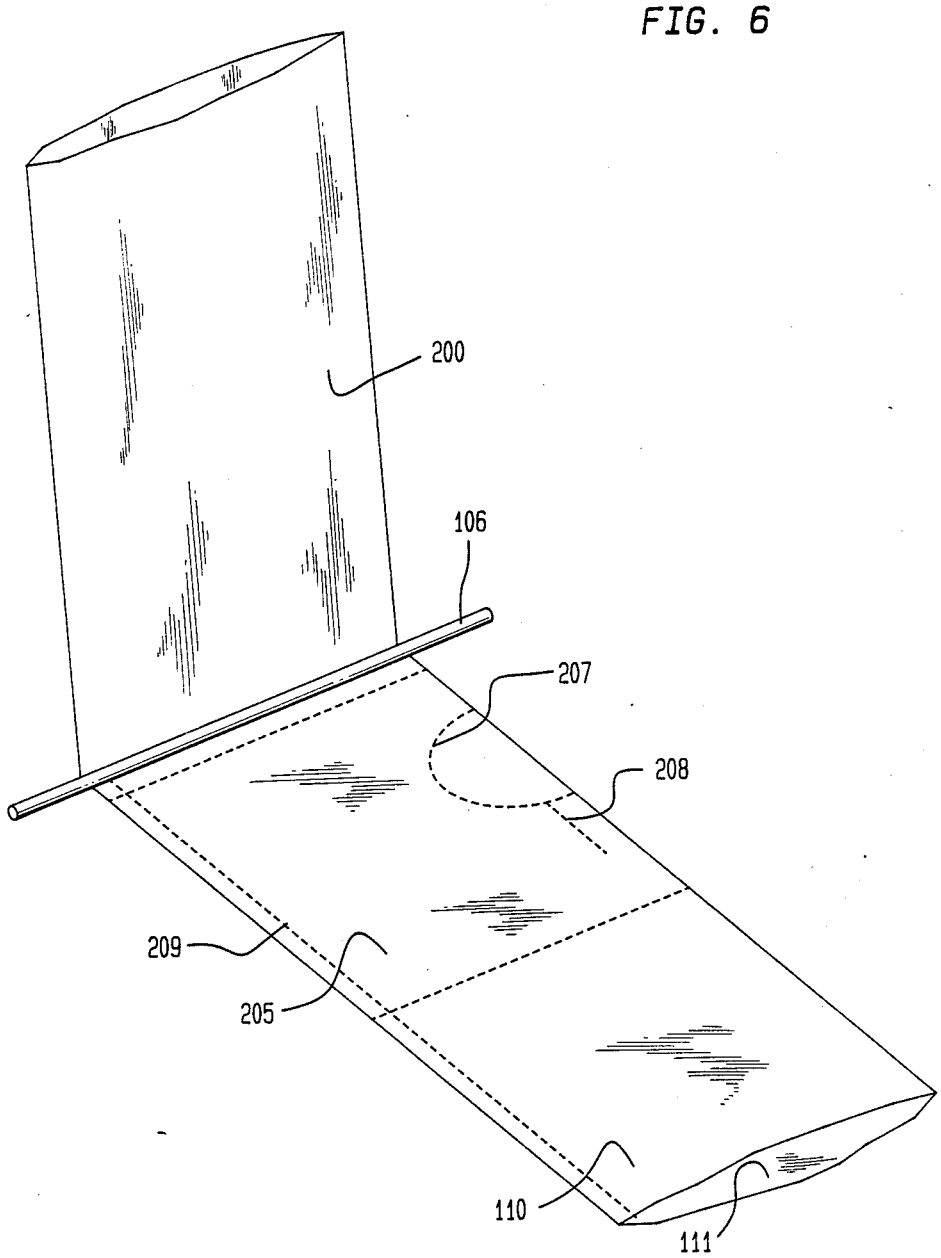
FIG. 6 is an isometric representation of a continuous web on which are formed, in accordance with a still further embodiment of the invention, a plurality of sanitary toilet seat covers.

FIG. 6 is an isometric representation of a continuous web 200 on which are formed, in accordance with a still further embodiment of the invention, a plurality of sanitary toilet seat covers substantially as described hereinabove with respects to FIG. 5. In this embodiment, however, all of the perforation lines required in a toilet seat cover 205 can be made from one side. Such perforation lines can be made by a perforation line forming device of known type, which is illustrated schematically in this figure by a function box designated as 201. More specifically, double-layer perforation line 207 defines the blank central portion, and facilitates removal thereof from the edge of continuous web 200. Double-layer perforation line 208, in combination with double-layer perforation line 207, define the protective front flap. Along the other edge of continuous web 200, a longitudinal perforation line 209 is provided. Perforation line 209 may be of either the single- or double-layer type, and serves to facilitate deployment of the sanitary toilet seat cover. Features of the embodiment of FIG. 6 which bear analogous correspondence to features of FIG. 5 are similarly designated.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are preffered to facilitate comprehension of the invention, and should not be construed to limit the scope thereof.

What is claimed is:

1. A sanitary cover arrangement for a toilet seat, the arrangement comprising a sheet of nonporous material formed as one of a plurality of sequentially arranged sheets of said nonporous material obtained from a continuous sleeve of said nonporous material, said continuous web of nonporous material being collapsed to form first and second layers of nonporous material with first and second folds arranged longitudinally along respective edges of said continuous web where said first and second layers join one another, each of said sheets being separated from sequentially prior and sequentially subsequent ones of others of said sheets of said nonporous material by respective longitudinally transverse perforation lines in said first and second layers, said first layer having a further perforation line extending therealong longitudinally with respect to said continuous web of nonporous material in the vicinity of said first fold for facilitating unfolding of said sheet of nonporous material during use of the sanitary cover arrangement, and having a waste portion in the form of a removable blank central portion arranged in the vicinity of said second fold, and a protective portion configured to overlie the toilet seat, said waste and protective portions being separated from one another by a perforation line, said protective portion further having a protective flap portion formed integrally therewith, said protective flap portion being defined in said protective portion at least partially by perforation lines.

2. The sanitary cover arrangement of claim 1 wherein said waste portion is outlined by a perforation line for facilitating separation thereof from said protective portion.

* * * * *